US011839307B2

(12) United States Patent
Wang et al.

(10) Patent No.: US 11,839,307 B2
(45) Date of Patent: Dec. 12, 2023

(54) LUMBAR SUPPORT MECHANISM AND HEAD TILT MECHANISM AND ADJUSTABLE BED THEREWITH

(71) Applicant: Nisco Co., Ltd, Jiangsu (CN)

(72) Inventors: Wei Wang, Jiangsu (CN); Jian Xie, Jiangsu (CN); Yifan Mao, Jiangsu (CN)

(73) Assignee: NISCO CO., LTD, Jiangsu (CN)

( * ) Notice: Subject to any disclaimer, the term of this patent is extended or adjusted under 35 U.S.C. 154(b) by 358 days.

(21) Appl. No.: 17/318,006

(22) Filed: May 12, 2021

(65) Prior Publication Data

US 2021/0259432 A1 Aug. 26, 2021

Related U.S. Application Data

(63) Continuation-in-part of application No. 16/729,700, filed on Dec. 30, 2019, now Pat. No. 11,317,729.

(60) Provisional application No. 63/029,800, filed on May 26, 2020, provisional application No. 62/790,583, filed on Jan. 10, 2019, provisional application No. 62/789,047, filed on Jan. 7, 2019, provisional application No. 62/789,062, filed on Jan. 7, 2019.

(51) Int. Cl.

| | |
|---|---|
| ***A47C 20/12*** | (2006.01) |
| ***A47C 19/02*** | (2006.01) |
| ***A47C 20/04*** | (2006.01) |

(52) U.S. Cl.

CPC ..... *A47C 20/12* (2013.01); *A47C 19/025* (2013.01); *A47C 20/041* (2013.01)

(58) Field of Classification Search

CPC ..... A47C 20/12; A47C 20/041; A47C 20/027; A47C 20/025; A47C 7/462; A61G 7/07; A61G 7/015

See application file for complete search history.

(56) References Cited

U.S. PATENT DOCUMENTS

| | | | | |
|---|---|---|---|---|
| 9,808,093 | B2 * | 11/2017 | Rawls-Meehan | A47C 20/04 |
| 11,224,294 | B2 * | 1/2022 | Nava | A47C 20/041 |
| 2009/0178201 | A1 * | 7/2009 | Lujan | A61G 7/07 5/630 |

(Continued)

FOREIGN PATENT DOCUMENTS

| | | | | |
|---|---|---|---|---|
| WO | WO-2016179336 | A1 * | 11/2016 | A61G 7/018 |
| WO | WO-2018040719 | A1 * | 3/2018 | A47C 19/04 |

*Primary Examiner* — Justin C Mikowski
*Assistant Examiner* — Alison N Labarge
(74) *Attorney, Agent, or Firm* — Locke Lord LLP; Tim Tingkang Xia, Esq.

(57) ABSTRACT

The lumbar support mechanism and an adjustable bed having the same. The lumbar support mechanism includes a lumbar support member; first, second, third and fourth support legs; a linkage member; and first and second lumbar support brackets operably attachable to a back platform of the adjustable bed. The first and second support legs are pivotally connected between the lumbar support member and the linkage member; and the third and fourth support legs are pivotally connected between the first and second support legs, and the first and second lumbar support brackets, respectively, such that the lumbar support member is operably movable between a retracted position and an expanded (ejected) position when the linkage member moves between first and second positions. The lumbar support is provided when the lumbar support member is in the ejected position.

18 Claims, 7 Drawing Sheets

(56) References Cited

U.S. PATENT DOCUMENTS

| | | | | |
|---|---|---|---|---|
| 2011/0101749 | A1* | 5/2011 | Shih | A47C 7/425<br>297/284.7 |
| 2013/0145553 | A1* | 6/2013 | Shih | A61G 7/015<br>5/624 |
| 2014/0000033 | A1* | 1/2014 | Clenet | A61G 7/018<br>5/613 |
| 2017/0215589 | A1* | 8/2017 | Bullard | A47C 7/462 |
| 2017/0295943 | A1* | 10/2017 | Barr | A47C 19/025 |
| 2020/0154899 | A1* | 5/2020 | Brown | A47C 20/12 |
| 2020/0237101 | A1* | 7/2020 | Liu | A47C 20/041 |

* cited by examiner

LUMBAR SUPPORT MECHANISM AND HEAD TILT MECHANISM AND ADJUSTABLE BED THEREWITH

CROSS-REFERENCE TO RELATED PATENT APPLICATIONS

This application claims priority to and the benefit of U.S. Provisional Patent Application Ser. No. 63/029,800, filed May 26, 2020, which is incorporated herein in its entirety by reference.

This application is also a continuation-in-part application of U.S. patent application Ser. No. 16/729,700, filed Dec. 30, 2019, which itself claims priority to and the benefit of U.S. Provisional Patent Application Ser. Nos. 62/789,062 filed Jan. 7, 2019, 62/789,047 filed Jan. 7, 2019, and 62/790,583 filed Jan. 10, 2019, which are incorporated herein in their entireties by reference.

FIELD OF THE INVENTION

The invention generally relates to a bed, and more particular to a lumbar support mechanism and a head tilt mechanism and an adjustable bed having the same.

BACKGROUND OF THE INVENTION

Sleep is critical for people in every aspect of their lives. Beds are necessary furniture for people to sleep on. Adjustable beds are used more and more in healthcare and home. However, the adjustability of conventional adjustable beds is very limited. Thus, it would be beneficial and desirable for people to have a bed system that is capable of adjusting body positions at user's preference so that the user achieves maximum comfort when using the bed system.

SUMMARY OF THE INVENTION

This invention, in one aspect, relates to a lumbar support mechanism usable in an adjustable bed.

The lumbar support mechanism includes a lumbar support member; first, second, third and fourth support legs, each support leg having an upper end and a lower end; a linkage member having a first end and an opposite, second end; and first and second lumbar support brackets operably attachable to a back platform of the adjustable bed.

The upper ends of the first and second support legs are pivotally connected to the lumbar support member, and the lower ends of the first and second support legs are pivotally connected to the first and second ends of the linkage member, respectively; and the upper ends of the third and fourth support legs are pivotally connected to the first and second support legs, respectively, and the lower ends of the third and fourth support legs are pivotally connected to the first and second lumbar support brackets, respectively, such that a distance between the lumbar support member and the linkage member is changeable between minimal and maximal distances when the linkage member moves between first and second positions.

In one embodiment, the lumbar support mechanism further comprises a lumbar support actuator for operably moving the linkage member between the first and second positions.

In one embodiment, the lumbar support actuator comprises a motor member, an outer tube extending from the motor member, and an activation rod received in the outer tube, engaged with the motor member and configured to be telescopically movable relative to the outer tube according to a direction of motor rotation.

In one embodiment, the motor member is operably attachable to the back platform, and a distal end of the activation rod is pivotally connected to one of the first and second ends of the linkage member.

In one embodiment, one of the first and second lumbar support brackets has a guiding slot having first and second ends, and the distal end of the activation rod is pivotally connected to said one of the first and second ends of the linkage member by a guiding pin that is received and movable in the guiding slot.

In one embodiment, when the guiding pin moves to the first end of the guiding slot, the linkage member moves to the first position, and when the guiding pin moves the second end of the guiding slot, the linkage member moves to the second position.

In one embodiment, the first and second support legs are parallel to each other, the third and fourth support legs are parallel to each other, and the lumbar support member and the linkage member are parallel to each other.

In another aspect, the invention relates to an adjustable bed comprising a frame structure having a back frame and a foot frame; a plurality of platforms disposed on the frame structure, the plurality of platforms comprising at least a back platform having an opening; and a lifting mechanism positioned between the frame structure and the plurality of platforms for operably adjusting positions of at least one of the plurality of platforms so as to adjust the adjustable bed at a desired position; and a lumbar support mechanism received in the opening of and secured to the back platform for operably providing lumbar support.

In one embodiment, the lumbar support mechanism comprises a lumbar support member; first, second, third and fourth support legs, each support leg having an upper end and a lower end; a linkage member having a first end and an opposite, second end; first and second lumbar support brackets attached to the back platform, wherein the upper ends of the first and second support legs are pivotally connected to the lumbar support member, and the lower ends of the first and second support legs are pivotally connected to the first and second ends of the linkage member, respectively; and the upper ends of the third and fourth support legs are pivotally connected to the first and second support legs, respectively, and the lower ends of the third and fourth support legs are pivotally connected to the first and second lumbar support brackets, respectively, such that a distance between the lumbar support member and the linkage member is changeable between minimal and maximal distances when the linkage member moves between first and second positions; and a lumbar support actuator for operably moving the linkage member between the first and second positions.

In one embodiment, the lumbar support actuator comprises a motor member, an outer tube extending from the motor member, and an activation rod received in the outer tube, engaged with the motor member and configured to be telescopically movable (expandable or contractible) relative to the outer tube according to a direction of motor rotation.

In one embodiment, the motor member is operably attachable to the back platform, and a distal end of the activation rod is pivotally connected to one of the first and second ends of the linkage member by a guiding pin that is received and movable in a guiding slot defined in one of the first and second lumbar support brackets.

In one embodiment, when the guiding pin moves to the first end of the guiding slot, the linkage member moves to the first position, and when the guiding pin moves the second end of the guiding slot, the linkage member moves to the second position.

In one embodiment, the lifting mechanism comprises a back lifting assembly and a leg lifting assembly.

The back lifting assembly comprises a back lifting bracket pivotally connected to the back frame, and a back lifting actuator pivotally connected between the back lifting bracket and the back frame for operably driving the back lifting bracket to pivotally move in an upward rotating direction or a downward rotating direction relative to the back frame.

In one embodiment, the back lifting actuator comprises a motor member, an outer tube extending from the motor member, and an activation rod having a first end portion received in the outer tube and an opposite, second end portion, wherein the activation rod is engaged with the motor member and configured to be telescopically movable relative to the outer tube according to a direction of motor rotation, wherein the motor member is pivotally connected to the back frame and the second end portion of the activation rod pivotally connected to the back lifting bracket, or wherein the motor member is pivotally connected to the back lifting bracket and the second end portion of the activation rod pivotally connected to the back frame.

The foot lifting assembly comprises a foot lifting bracket pivotally connected to the foot frame, and a foot lifting actuator pivotally connected between the foot lifting bracket and the foot frame for operably driving the foot lifting bracket to pivotally move in an upward rotating direction or a downward rotating direction relative to the foot frame.

In one embodiment, the leg lifting actuator comprises a motor member, an outer tube extending from the motor member, and an activation rod having a first end portion received in the outer tube and an opposite, second end portion, wherein the activation rod is engaged with the motor member and configured to be telescopically movable relative to the outer tube according to a direction of motor rotation, wherein the motor member is pivotally connected to the leg frame and the second end portion of the activation rod pivotally connected to the leg lifting bracket, or wherein the motor member is pivotally connected to the leg lifting bracket and the second end portion of the activation rod pivotally connected to the leg frame.

In one embodiment, the plurality of platforms further comprises a head platform.

In one embodiment, the adjustable bed further comprises a head tilt mechanism including a head platform tilting actuator pivotally connected to the head platform and the back platform for operably adjusting the head platform in a tilting position or a flat position relative to the back platform.

In one embodiment, the head platform tilting actuator comprises a motor member, an outer tube extending from the motor member, an activation rod received in the outer tube, engaged with the motor member and configured to be telescopically movable relative to the outer tube according to a direction of motor rotation, wherein the motor member is pivotally connected to the back platform through a back platform mounting bracket, and the activation rod has a distal end portion pivotally connected to the head platform through a head platform mounting bracket.

In one embodiment, the adjustable bed further comprises a folding mechanism connecting the back frame and the foot frame such that the back frame and the foot frame are pivotally foldable to one another at the folding mechanism.

These and other aspects of the invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
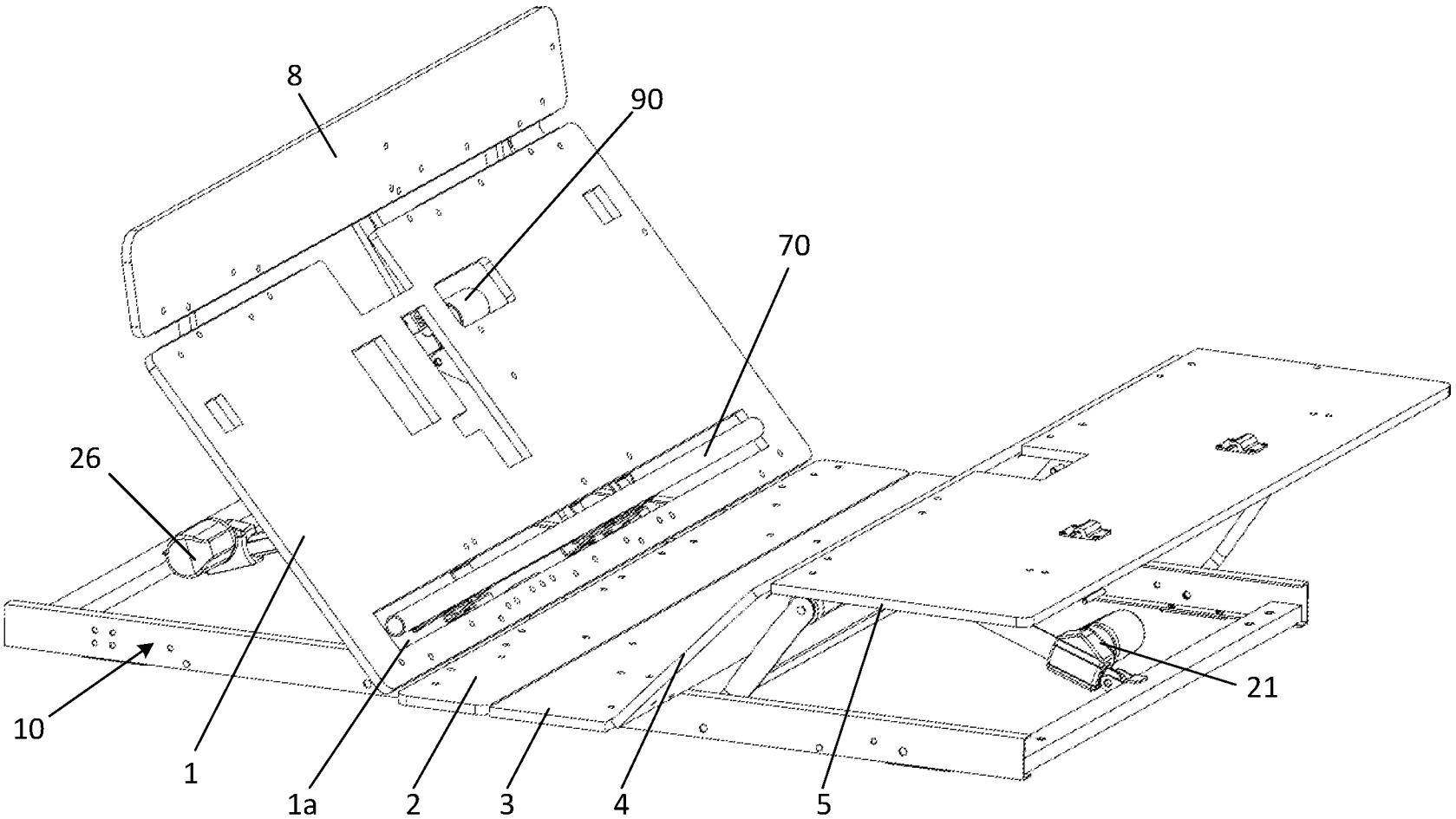
FIG. 1 shows schematically a front perspective view of an adjustable bed according to one embodiment of the invention.

The invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the invention or of any exemplified term. Likewise, the invention is not limited to various embodiments given in this specification.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

As used herein, "around", "about", "substantially" or "approximately" shall generally mean within 20 percent, preferably within 10 percent, and more preferably within 5 percent of a given value or range. Numerical quantities given herein are approximate, meaning that the term "around", "about" "substantially" or "approximately" can be inferred if not expressly stated.

As used in this specification, the term "platform" refers to a bed board or a bed panel.

As used in this specification, the phrase "at least one of A, B, and C" should be construed to mean a logical (A or B or C), using a non-exclusive logical OR. As used herein, the term "and/or" includes any and all combinations of one or more of the associated listed items.

Embodiments of the invention are illustrated in detail hereinafter with reference to accompanying drawings. The description below is merely illustrative in nature and is in no way intended to limit the invention, its application, or uses. The broad teachings of the invention can be implemented in a variety of forms. Therefore, while this invention includes particular examples, the true scope of the invention should not be so limited since other modifications will become apparent upon a study of the drawings, the specification, and the following claims. For purposes of clarity, the same reference numbers will be used in the drawings to identify similar elements. It should be understood that one or more steps within a method may be executed in different order (or concurrently) without altering the principles of the invention.

In accordance with the purposes of this invention, as embodied and broadly described herein, this invention, in one aspect, relates to a lumbar support mechanism, a head tilt mechanism and an adjustable bed having the same.

Figure 4:
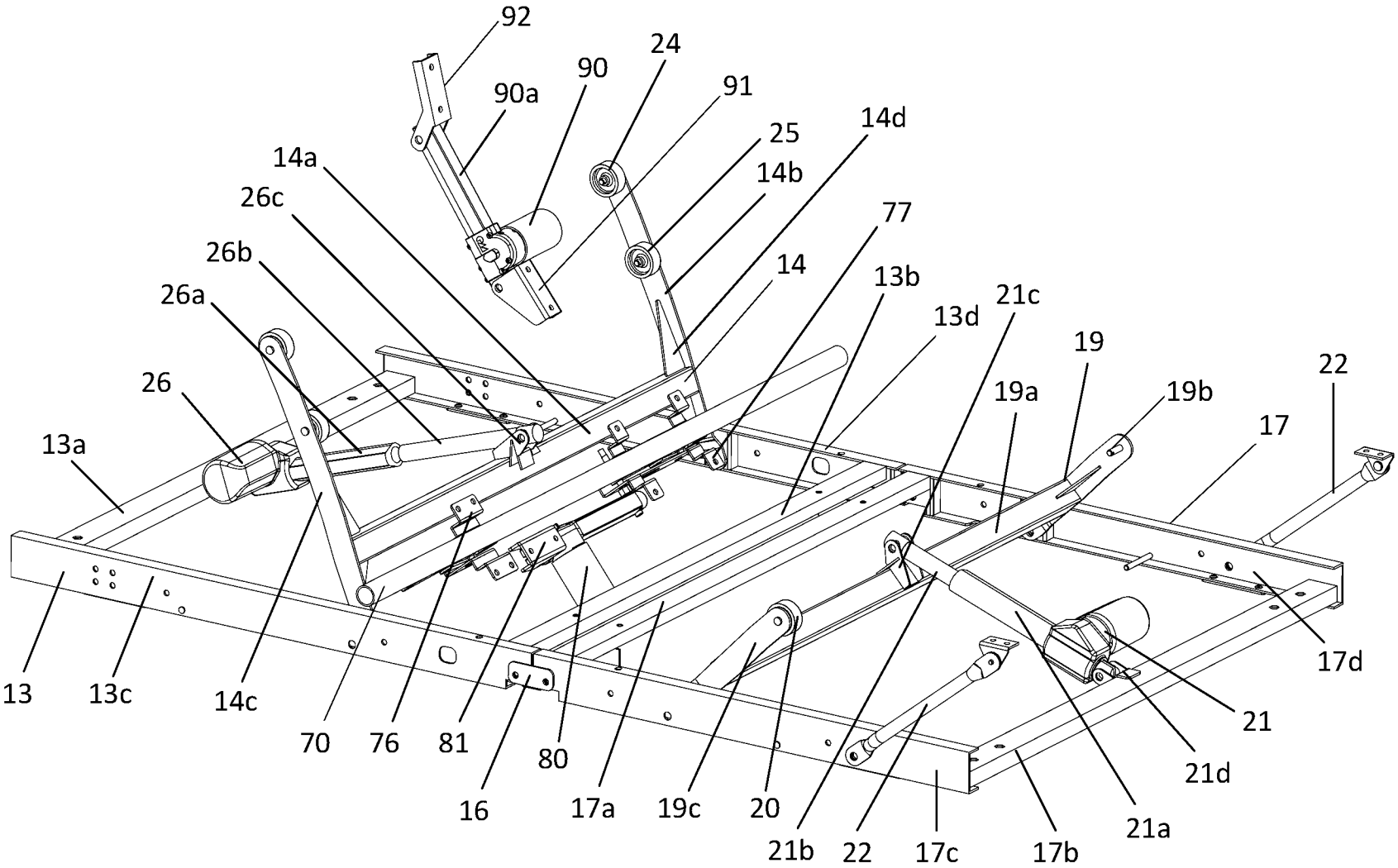
FIG. 4 shows schematically another structural view of the adjustable bed shown in FIG. 1.
Figure 5:
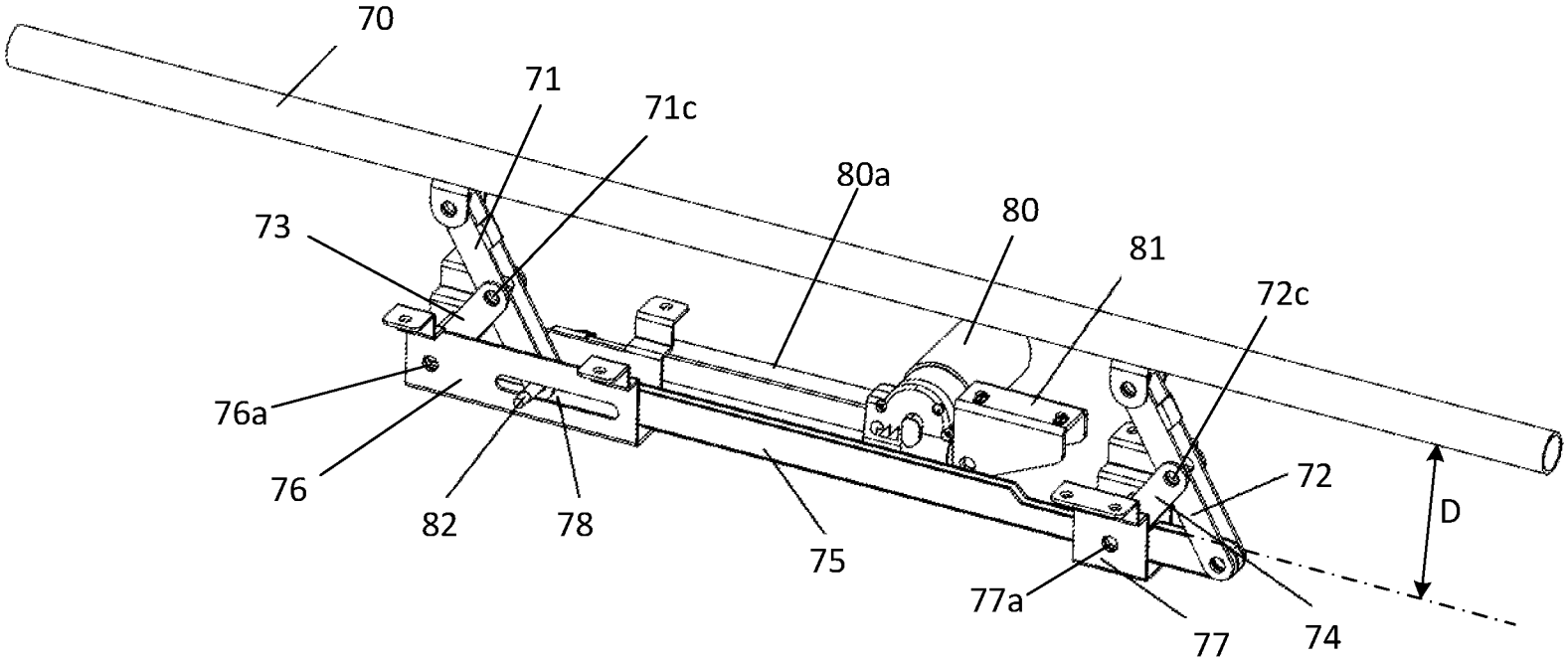
FIG. 5 shows schematically a perspective view of a lumbar support mechanism usable in the adjustable bed shown in FIG. 1.
Figure 6:
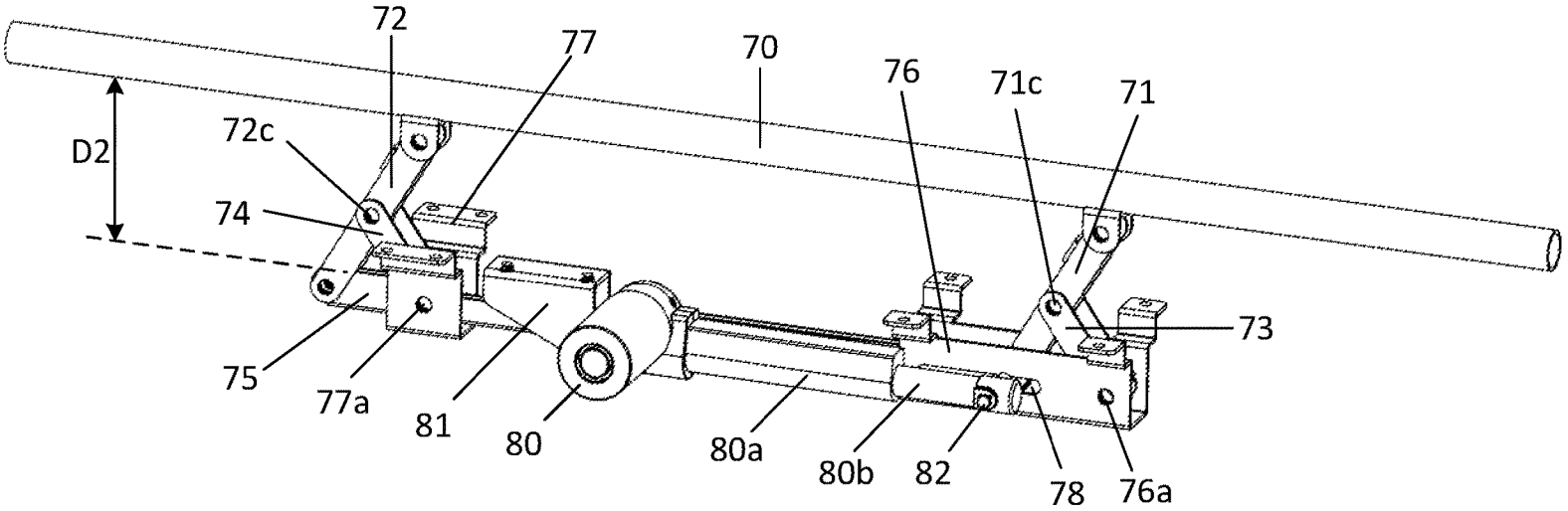
FIG. 6 shows schematically another perspective view of the lumbar support mechanism shown in FIG. 5.
Figure 7:
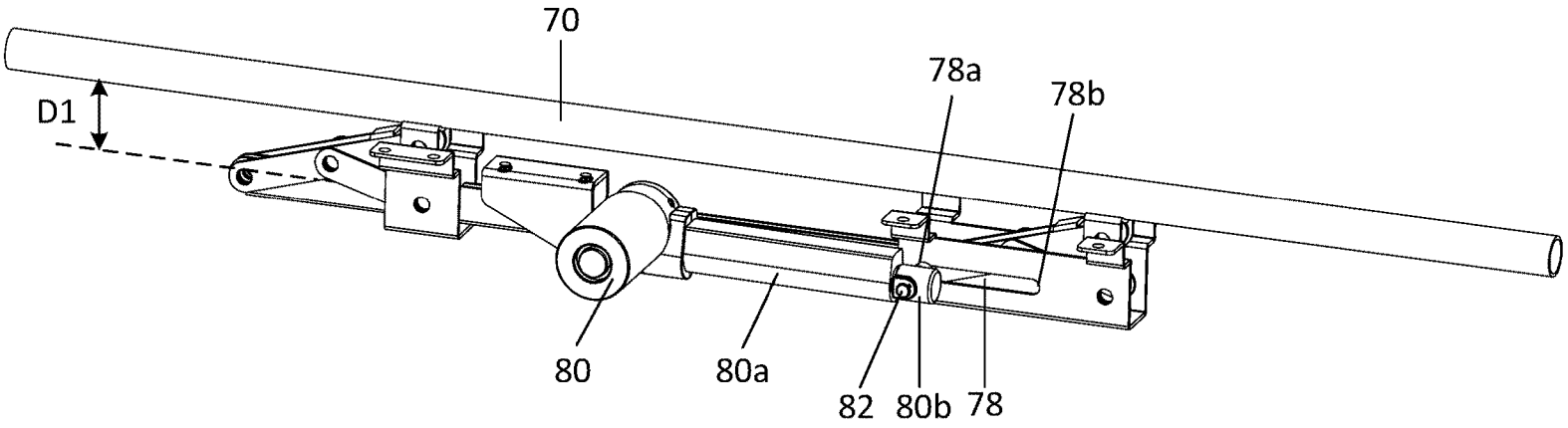
FIG. 7 shows schematically yet another perspective view of the lumbar support mechanism shown in FIG. 5.
Figure 8:
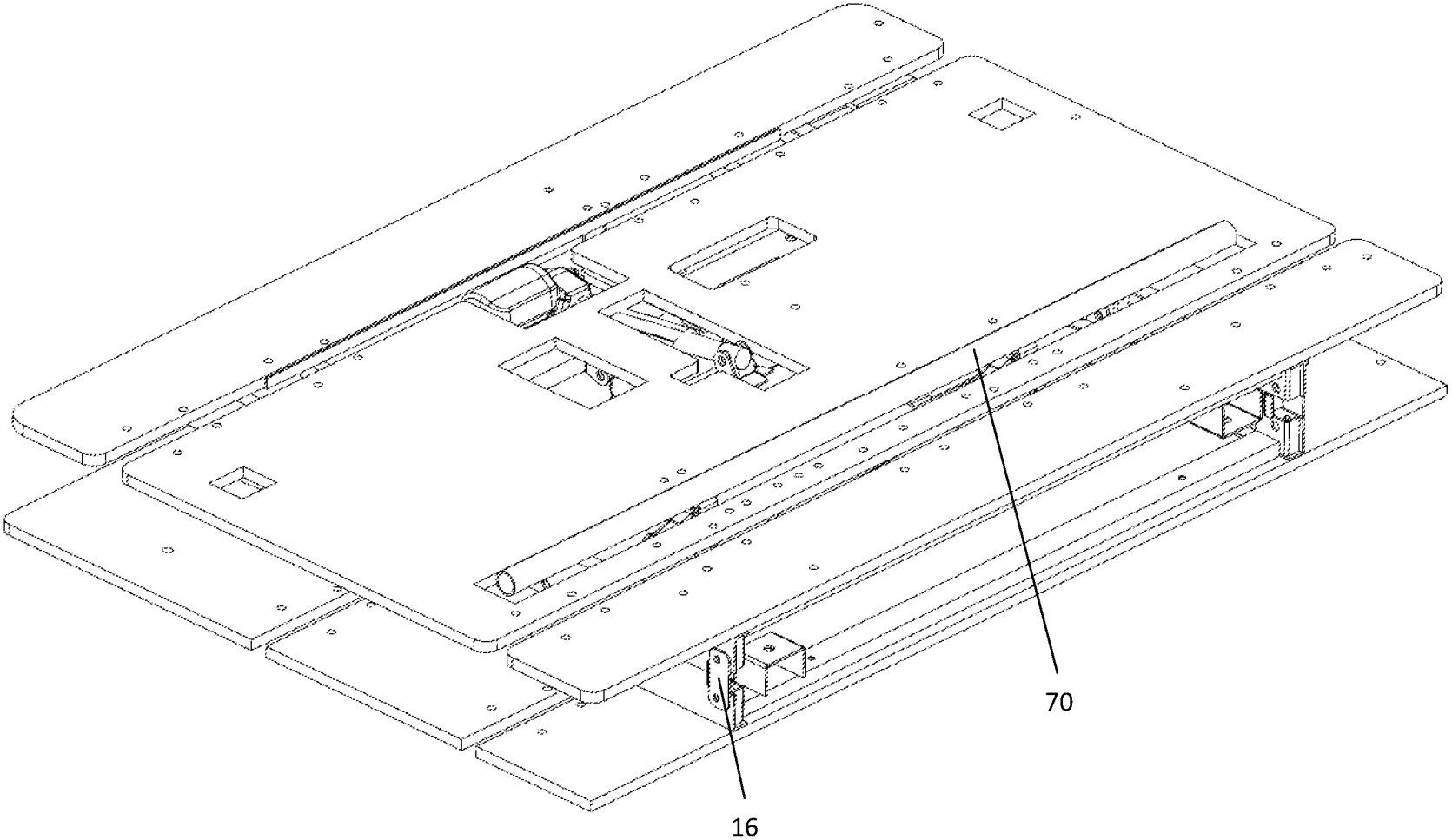
FIG. 8 shows schematically yet another front perspective view of the structural frame of the adjustable bed shown in FIG. 1 in a folded state.

Referring to FIGS. 1-7, and particularly to FIGS. 5-7, one embodiment of the lumbar support mechanism is shown according to the invention.

The lumbar support mechanism includes a lumbar support member 70; first, second, third and fourth support legs 71-74, each support leg having an upper end and a lower end; a linkage member 75 having a first end and an opposite, second end; and first and second lumbar support brackets 76 and 77 operably attachable to the back platform 1 of the adjustable bed. The lumbar support member 70 can be a bar, a rod, or a panel.

The upper ends of the first and second support legs 71 and 72 are pivotally connected to the lumbar support member 70, and the lower ends of the first and second support legs 71 and 72 are pivotally connected to the first and second ends of the linkage member 75, respectively, such that the first and second support legs 71 and 72 are parallel to each other, and the lumbar support member 70 and the linkage member 75 are parallel to each other. Both of the first and second support legs 71 and 72 have the same length.

In addition, the upper ends of the third and fourth support legs 73 and 74 are pivotally connected to the middle portions 71*c* and 72*c* of the first and second support legs 71 and 72, respectively, and the lower ends of the third and fourth support legs 73 and 74 are pivotally connected to the first and second lumbar support brackets 76 and 77 at pivotal points 76*a* and 77*a*, respectively, such that the third and fourth support legs 73 and 74 are parallel to each other. In certain embodiments, the third and fourth support legs 73 and 74 have the same length that is approximately an half of the length of the first and second support legs 71 and 72. According to the invention, none of the first, second, third and fourth support legs 71-74 is attached or mounted to a bed platform (board).

As such an arrangement, when the linkage member 75 moves between first and second positions, a distance D between the lumbar support member 70 and the linkage member 75 is changeable between a minimal distance D1 (FIG. 7) and a maximal distance D2 (FIG. 6).

The lumbar support mechanism further comprises a lumbar support actuator for operably driving the linkage member 75 to move between the first and second positions. The lumbar support actuator comprises a motor member 80, an outer tube 80*a* extending from the motor member 80, and an activation rod 80*b* received in the outer tube 80*a*, engaged with the motor member 80 and configured to be telescopically movable (expandable or contractible) relative to the outer tube 80*a* according to a direction of motor rotation. The motor member 80 is operably attachable to the back platform, and a distal end of the activation rod 80*b* is pivotally connected to the first end of the linkage member 75 by a guiding pin 82 that is received and movable in a guiding slot 78 defined in the first lumbar support bracket 76. When the activation rod 80*b* is contracted (retracted), it drives the guiding pin 82 to move to the first end 78*a* of the guiding slot 78, which, in turn, drives the linkage member 75 to move to the first position, whereby the lumbar support member 70 and the linkage member 75 has the minimal distance D1, as shown in FIG. 7. Accordingly, the lumbar support member 70 is in a retracted position. When the activation rod 80*b* is expanded, it drives the guiding pin 82 to move to the second end 78*b* of the guiding slot 78, which, in turn, drives the linkage member 75 to move to the second position, whereby the lumbar support member 70 and the linkage member 75 has the maximal distance D2, as shown in FIG. 6. Accordingly, the lumbar support member 70 is in an ejected (support) position.

The lumbar support mechanism can be used in an adjustable bed for operably providing lumbar support.

As shown in FIGS. 1-4, the adjustable bed includes a fame structure 10 having a back frame 13 and a foot frame 17, a back lifting assembly including a back lifting bracket and a back lifting actuator, a foot lifting assembly having a leg lifting bracket and a foot lifting actuator, a lumbar support mechanism, and a folding mechanism 16.

The adjustable bed further includes a plurality of platforms disposed on the back frame 13, the back lifting assembly, the foot frame 17 and the foot lifting assembly. The plurality of platforms includes a head platform 8, a back platform 1 and an upper seat platform 2 mounted on the back frame 13. The upper seat platform 2 is hinged with the back platform 1 through hinges 23. The plurality of platforms also includes a lower seat platform 3 mounted on the foot frame 17, a thigh platform 4, and a leg platform 5. The lower seat platform 3 is hinged with the thigh platform 4 through hinges 23, and the thigh platform 4 is hinged with the leg platform 5 through hinges 23. The back platform 1 has an opening 1*a*, defined corresponding to a lumber portion of a user.

The back frame 13 includes an upper back frame rail 13*a*, a lower back frame rail 13*b*, and a pair of side back frame rails 13*c* and 13*d*. The upper back frame rail 13*a* and the lower back frame rail 13*b* are longitudinally spaced and transversely extended, and the pair of side back frame rails 13*c* and 13*d* is transversely spaced and longitudinally extended, and rigidly connected to the upper back frame rail 13*a* and the lower back frame rail 13*b*, such that the upper back frame rail 13*a* and the lower back frame rail 13*b* and the pair of side back frame rails 13*c* and 13*d* are co-planar in a rectangle form. Preferably, the connection of the pair of side back frame rails 13*c* and 13*d* to the upper and lower back frame rails 13*a* and 13*b* is by welding ends of the upper back frame rail 13*a* onto end portions of the pair of side back frame rails 13*c* and 13*d*, and welding ends of the lower back frame rail 13*b* onto opposite end portions of the pair of side back frame rails 13*c* and 13*d*. Other connecting means such as screw connections can also be utilized to practice the invention.

The back lifting assembly has a back lifting bracket 14 pivotally connected to the back frame 13, and a back lifting actuator pivotally connected between the back lifting bracket 14 and the back frame 13 for operably driving the back lifting bracket 14 to pivotally move in an upward rotating direction or a downward rotating direction relative to the back frame 13.

The back lifting bracket 14 includes a middle bar 14*a* and a pair of swing arms 14*b* and 14*c*. Each of the pair of swing arms 14*b* and 14*c* is in an arc-shaped design. The pair of swing arms 14*b* and 14*c* is transversely spaced and longitudinally extended, and rigidly connected to ends of the transversely extending middle bar 14*a* in an H-shaped form. Each of the pair of swing arms 14*b* and 14*c* has a first end portion and an opposite, second end portion. The first end portion of each swing arm 14*b* or 14*c* is pivotally mounted to a respective one of the side back frame rails 13*c* and 13*d* of the back frame 13 through a pivot. The second end portion of at least one of the swing arms 14*b* and 14*c* is equipped with a first lifting wheel 25 and a second lifting wheel 24, as shown in FIG. 4. Practically, the second end portion of the swing arms 14*c* may also be equipped with the first lifting wheel 25 and the second lifting wheel 24. In addition, each of the pair of swing arms 14*b* and 14*c* may be reinforced by a pair of reinforcing pieces 14*d* (FIG. 4) rigidly connected to an end portion of the middle bar 14*a* on either side.

The back lifting actuator includes a motor member 26, an outer tube 26*a* extending from the motor member 26, and an activation rod 26*b* received in the outer tube 26*a*, engaged with the motor member 26 and configured to be telescopically movable relative to the outer tube 26*a* according to a direction of motor rotation. The motor member 26 is pivotally connected to the upper back frame rail 13*a* of the back frame 13 through a first bracket 26*d*. The activation rod 26*b* has a distal end portion pivotally connected to the middle bar 14*a* of the back lifting bracket 14 through a second bracket 26*c*. Accordingly, when the activation rod 26*b* is expanded, it drives the back lifting bracket 14 to rotate in an upward rotation direction along the pivot point at in the first end portion of each swing arm 14*b*/14*c* of the back lifting bracket 14, which in turn causes the back platform 1 to slidably move against the back lifting wheels 24 and 25 in the same upward rotation direction. When the activation rod 26*b* is contracted, it drives the back lifting bracket 14 to rotate in an downward rotation direction along the pivot point at the first end portion of each swing arm 14*b*/14*c* of the back lifting bracket 14, which in turn causes the back platform 1 to slidably move against the back lifting wheels 24 and 25 in the same downward rotation direction.

The foot frame 17 includes an upper foot frame rail 17*a*, a lower foot frame rail 17*b*, and a pair of side foot frame rails 17*c* and 17*d*. The upper foot frame rail 17*a* and the lower foot frame rail 17*b* are longitudinally spaced and transversely extended, and the pair of side foot frame rails 17*c* and 17*d* is transversely spaced and longitudinally extended, and rigidly connected to the upper foot frame rail 17*a* and the lower foot frame rail 17*b*, such that the upper foot frame rail 17*a* and the lower foot frame rail 17*b* and the pair of side foot frame rails 17*c* and 17*d* are co-planar in a rectangle form. Preferably, the connection of the pair of side foot frame rails 17*c* and 17*d* to the upper and lower foot frame rails 17*a* and 17*b* is by welding ends of the upper foot frame rail 17*a* onto end portions of the pair of side foot frame rails 17*c* and 17*d*, and welding ends of the lower foot frame rail 17*b* onto opposite end portions of the pair of side foot frame rails 17*c* and 17*d*. Other connecting means such as screw connections can also be utilized to practice the invention.

The foot lifting assembly has a foot lifting bracket 19 pivotally connected to the foot frame 17, and a foot lifting actuator pivotally connected between the foot lifting bracket 19 and the foot frame 17 for operably driving the foot lifting bracket 19 to pivotally move in an upward rotating direction or a downward rotating direction relative to the foot frame 17.

The foot lifting bracket 19 includes a middle bar 19*a* and a pair of swing arms 19*b* and 19*c*. The pair of swing arms 19*b* and 19*c* is transversely spaced and longitudinally extended, and rigidly connected to ends of the transversely extending middle bar 19*a* in an H-shaped form. Each of the pair of swing arms 19*b* and 19*c* has a first end portion and an opposite, second end portion. The first end portion of each swing arm 19*b* or 19*c* is pivotally mounted to a respective one of the side foot frame rails 17*c* and 17*d* of the foot frame 17 through a pivot 15*a*. The second end portion of at least one of the swing arms 19*b* and 19*c* is equipped with a foot lifting wheel 20. Practically, the second end portion of the swing arms 19*b* may also be equipped with the foot lifting wheel 20. In addition, each of the pair of swing arms 19*b* and 19*c* may be reinforced by a reinforcing piece 19*d* (FIG. 4) rigidly connected to each end portion of the middle bar 19*a*.

The foot lifting actuator includes a motor member 21, an outer tube 21*a* extending from the motor member 21, and an activation rod 21*b* received in the outer tube 21*a*, engaged with the motor member 21 and configured to be telescopically movable relative to said outer tube 21*a* according to a direction of motor rotation. The motor member 21 is pivotally connected to the upper foot frame rail 17*a* of the foot frame 17 through a first bracket 21*d*. The activation rod 21*b* has a distal end portion pivotally connected to the middle bar 19*a* of the foot lifting bracket 19 through a second bracket 21*c*. As such, when the activation rod 21*b* is expanded, it drives the foot lifting bracket 19 to rotate in an upward rotation direction along the pivot point at in the first end portion of each swing arm 19*b*/19*c* of the foot lifting bracket 19, which in turn causes the thigh platform 4 to slidably move against the foot lifting wheels 20 in the same upward rotation direction. The movement of the thigh platform 4 in the same upward rotation direction in turn causes the foot platform 5 to move accordingly, so that the thigh platform 4 and the foot platform 5 are in a desired adjusting position, as shown in FIG. 1. When the activation rod 21*b* is contracted, it drives the foot lifting bracket 19 to rotate in an downward rotation direction along the pivot point at in the first end portion of each swing arm 19*b*/19*c* of the foot lifting bracket 19, which in turn causes the thigh platform 4 to slidably move against the foot lifting wheels 20 in the same downward rotation direction. The movement of the thigh platform 4 in the same downward rotation direction in turn causes the foot platform 5 to move, so that the thigh platform 4 and the foot platform 5 are in a flat position when the activation rod 21*b* is contracted at most, as shown in FIG. 2.

The lumbar support mechanism is received in the opening 1*a* of the back platform 1 and secured to the back side of the back platform 1 for operably providing lumbar support.

Figure 2:
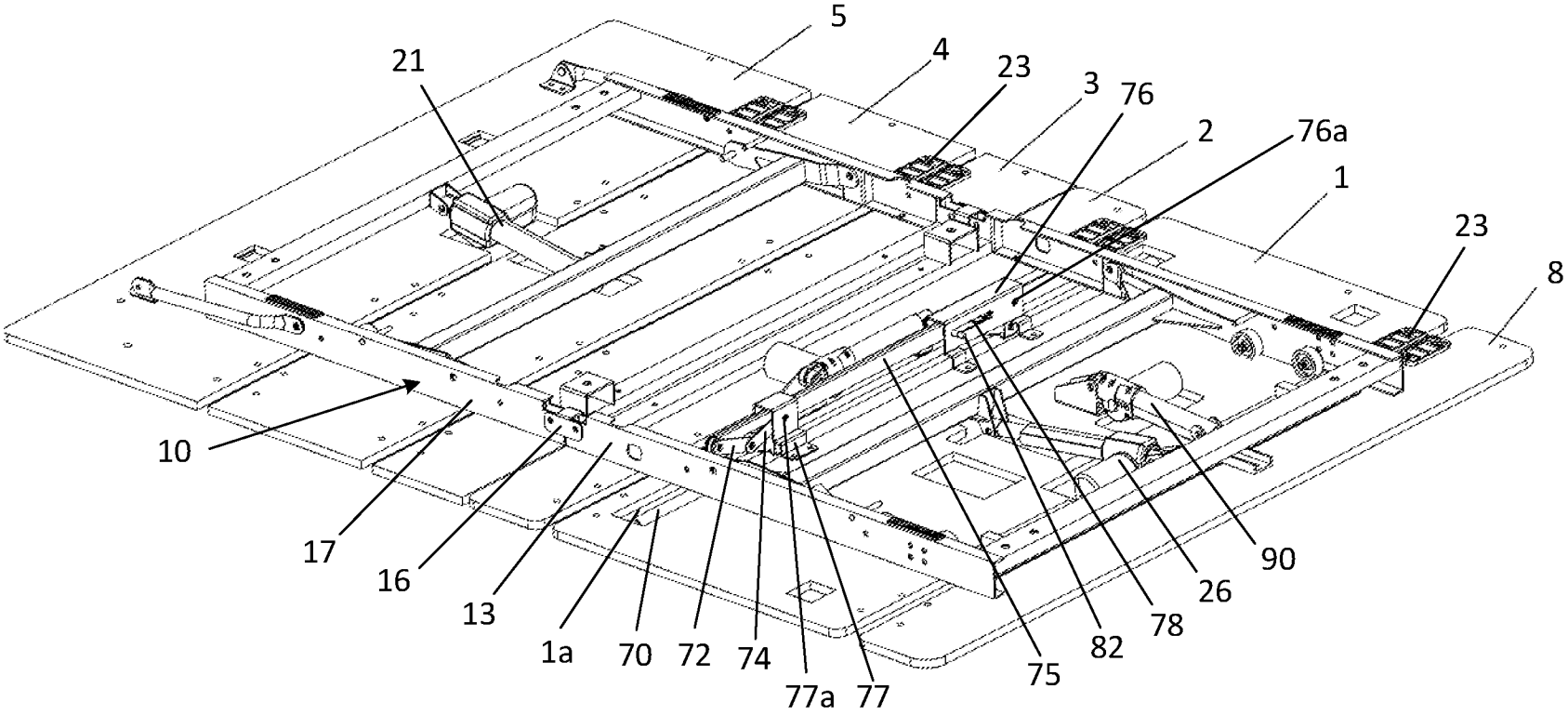
FIG. 2 shows schematically a back perspective view of the adjustable bed shown in FIG. 1.
Figure 3:
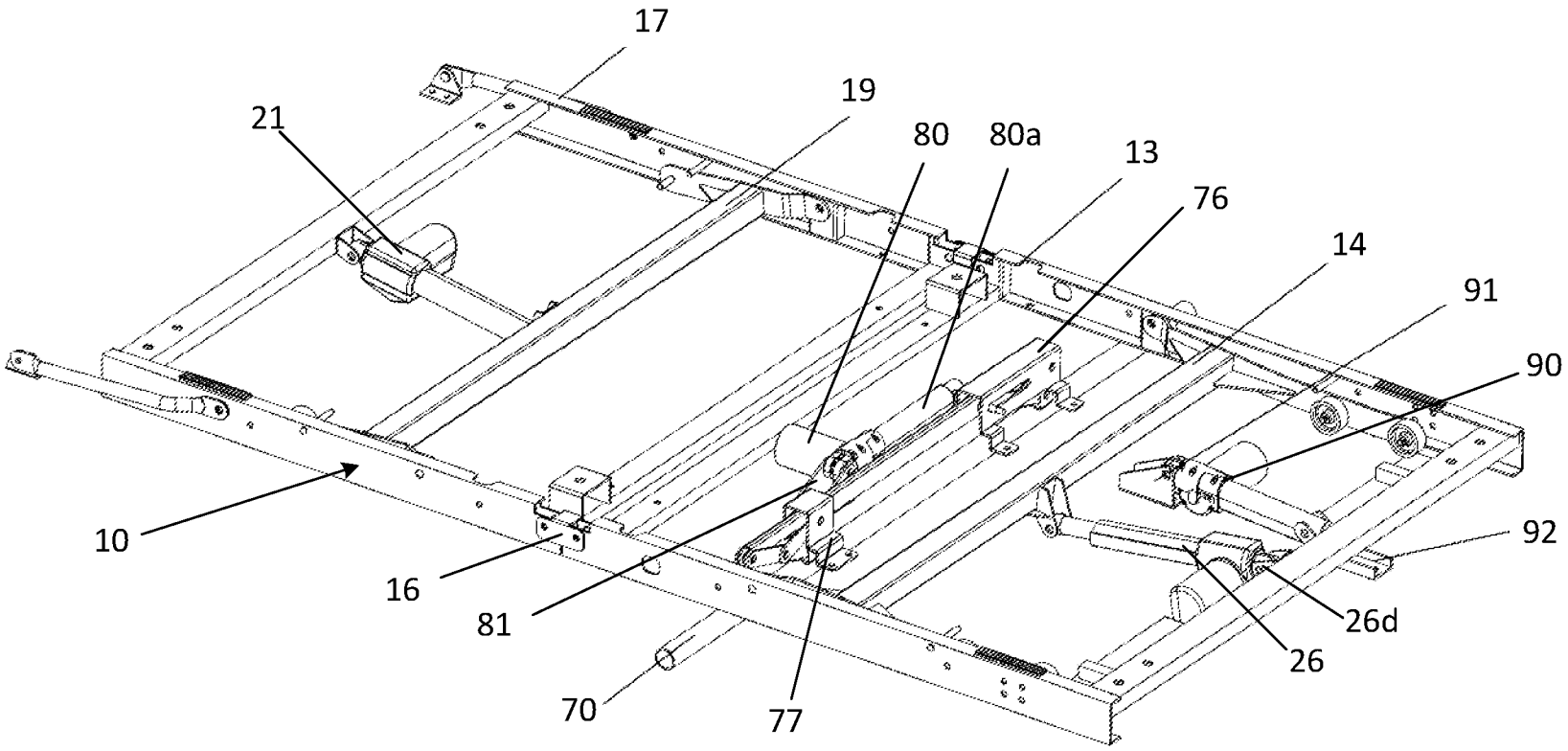
FIG. 3 shows schematically a structural view of the adjustable bed shown in FIG. 1.

As shown in FIGS. 5-7, the lumbar support mechanism includes a lumbar support member 70; first, second, third and fourth support legs 71-74, a linkage member 75, and first and second lumbar support brackets 76 and 77 mounted onto the back side of the back platform 1 of the adjustable bed, as shown in FIG. 2.

The upper ends of the first and second support legs 71 and 72 are pivotally connected to the lumbar support member 70, and the lower ends of the first and second support legs 71 and 72 are pivotally connected to the first and second ends of the linkage member 75, respectively, such that the first and second support legs 71 and 72 are parallel to each other, and the lumbar support member 70 and the linkage member 75 are parallel to each other. Both of the first and second support legs 71 and 72 have the same length.

In addition, the upper ends of the third and fourth support legs 73 and 74 are pivotally connected to the middle portions 71*c* and 72*c* of the first and second support legs 71 and 72, respectively, and the lower ends of the third and fourth support legs 73 and 74 are pivotally connected to the first and second lumbar support brackets 76 and 77 at pivotal points 76*a* and 77*a*, respectively, such that the third and fourth support legs 73 and 74 are parallel to each other. The first and second lumbar support brackets 76 and 77 are mounted to the back side of the back platform 1.

The lumbar support mechanism further comprises a lumbar support actuator for operably driving the linkage member 75 to move between the first and second positions. The lumbar support actuator comprises a motor member 80, an outer tube 80*a* extending from the motor member 80, and an activation rod 80*b* received in the outer tube 80*a*, engaged with the motor member 80 and configured to be telescopically movable relative to the outer tube 80*a* according to a direction of motor rotation. The motor member 80 is attached to the back side of the back platform by a motor bracket 81. The distal end of the activation rod 80*b* is pivotally connected to the first end of the linkage member 75 by a guiding pin 82 that is received and movable in a guiding slot 78 defined in the first lumbar support bracket 76. When the motor member 80 rotates to cause the activation rod 80*b* in a retracted (contracted) state, the guiding pin 82 moves to the first end 78*a* of the guiding slot 78, the linkage member 75 moves to the first position, and the lumbar support member 70 and the linkage member 75 has the minimal distance D1, as shown in FIG. 7. Accordingly, the lumbar support member 70 is in a retracted position. When the motor member 80 rotates to cause the activation rod 80*b* in an expanded state, the guiding pin 82 moves to the second end 78*b* of the guiding slot 78, the linkage member 75 moves to the second position, and the lumbar support member 70 and the linkage member 75 has the maximal distance D2, as shown in FIG. 6. Accordingly, the lumbar support member 70 is in an ejected (support) position, which provides the lumbar support.

As shown in FIG. 4, the head tilt mechanism includes a head platform tilting actuator having a motor member 90, an outer tube 90*a* extending from the motor member 90, an activation rod (not shown) received in the outer tube 90*a*, engaged with the motor member 90 and configured to be telescopically movable relative to the outer tube 90*a* according to a direction of motor rotation. The motor member 90 is pivotally connected to the back side of the back platform 1 through a back platform mounting bracket 91, and the activation rod has a distal end portion pivotally connected to the back side of the head platform 8 through a head platform mounting bracket 92. As such, when the activation rod is in the retracted (contracted) state, the head platform 8 and the back platform 1 are co-planed (FIG. 2), and when the activation rod is in the expanded state, the head platform 8 is tilted relative to the back platform 1 (FIG. 1). In addition, the folding mechanism 16 connects the back frame 13 and the foot frame 17 such that the back frame 13 and the foot frame 17 are pivotally foldable to one another at the folding mechanism 16. Preferably, the folding mechanism 16 is a hinge bracket, as shown in FIGS. 2-4 and 8. Other connecting means and other types of folding mechanism can also be utilized to practice the invention.

The adjustable bed also includes a controller electrically coupled to the back lifting actuators (motors), the leg lifting actuators (motors), the head tilt actuators (motors) and the lumbar support actuators (motors), so as to lift individually or cooperatively the head and back platforms 8 and 1, the thigh platform 4, and the leg platform 5 in desired positions, and to provide the massage effects to the user. A user lying on the adjustable bed can make adjustments as desired.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the invention pertains without departing from its spirit and scope. Accordingly, the scope of the invention is defined by the appended claims rather than the foregoing description and the exemplary embodiments described therein.

What is claimed is:

1. A lumbar support mechanism usable in an adjustable bed, comprising:

a lumbar support member;

first, second, third and fourth support legs, each support leg having an upper end and a lower end;

a linkage member having a first end and an opposite, second end; and first and second lumbar support brackets operably attachable to a back platform of the adjustable bed, wherein the upper ends of the first and second support legs are pivotally connected to the lumbar support member, and the lower ends of the first and second support legs are pivotally connected to the first and second ends of the linkage member, respectively; and the upper ends of the third and fourth support legs are pivotally connected to the first and second support legs, respectively, and the lower ends of the third and fourth support legs are pivotally connected to the first and second lumbar support brackets, respectively, such that a distance between the lumbar support member and the linkage member is changeable between minimal and maximal distances when the linkage member moves between first and second positions.

2. The lumbar support mechanism of claim 1, further comprising a lumbar support actuator for operably moving the linkage member between the first and second positions.

3. The lumbar support mechanism of claim 2, wherein the lumbar support actuator comprises a motor member, an outer tube extending from the motor member, and an activation rod received in the outer tube, engaged with the motor member and configured to be telescopically movable relative to the outer tube according to a direction of motor rotation.

4. The lumbar support mechanism of claim 3, wherein the motor member is operably attachable to the back platform, and a distal end of the activation rod is pivotally connected to one of the first and second ends of the linkage member.

5. The lumbar support mechanism of claim 4, wherein one of the first and second lumbar support brackets has a guiding slot having first and second ends, and the distal end of the activation rod is pivotally connected to said one of the first and second ends of the linkage member by a guiding pin that is received and movable in the guiding slot.

6. The lumbar support mechanism of claim 5, wherein when the guiding pin moves to the first end of the guiding slot, the linkage member moves to the first position, and when the guiding pin moves the second end of the guiding slot, the linkage member moves to the second position.

7. The lumbar support mechanism of claim 1, wherein the first and second support legs are parallel to each other, the third and fourth support legs are parallel to each other, and the lumbar support member and the linkage member are parallel to each other.

8. An adjustable bed, comprising:

a frame structure having a back frame and a foot frame;

a plurality of platforms disposed on the frame structure, the plurality of platforms comprising at least a back platform having an opening; and a lifting mechanism positioned between the frame structure and the plurality of platforms for operably adjusting positions of at least one of the plurality of platforms so as to adjust the adjustable bed at a desired position; and a lumbar support mechanism received in the opening of and secured to the back platform for operably providing lumbar support, wherein the lumbar support mechanism comprises:

a lumbar support member;

first, second, third and fourth support legs, each support leg having an upper end and a lower end;

a linkage member having a first end and an opposite, second end;

first and second lumbar support brackets attached to the back platform, wherein the upper ends of the first and second support legs are pivotally connected to the lumbar support member, and the lower ends of the first and second support legs are pivotally connected to the first and second ends of the linkage member, respectively; and the upper ends of the third and fourth support legs are pivotally connected to the first and second support legs, respectively, and the lower ends of the third and fourth support legs are pivotally connected to the first and second lumbar support brackets, respectively, such that a distance between the lumbar support member and the linkage member is changeable between minimal and maximal distances when the linkage member moves between first and second positions; and a lumbar support actuator for operably moving the linkage member between the first and second positions.

9. The adjustable bed of claim 8, wherein the lumbar support actuator comprises a motor member, an outer tube extending from the motor member, and an activation rod received in the outer tube, engaged with the motor member and configured to be telescopically movable relative to the outer tube according to a direction of motor rotation.

10. The adjustable bed of claim 9, wherein the motor member is operably attachable to the back platform, and a distal end of the activation rod is pivotally connected to one of the first and second ends of the linkage member by a guiding pin that is received and movable in a guiding slot defined in one of the first and second lumbar support brackets.

11. The adjustable bed of claim 10, wherein when the guiding pin moves to the first end of the guiding slot, the linkage member moves to the first position, and when the guiding pin moves the second end of the guiding slot, the linkage member moves to the second position.

12. The adjustable bed of claim 8, wherein the lifting mechanism comprises a back lifting assembly and a leg lifting assembly, wherein the back lifting assembly comprises a back lifting bracket pivotally connected to the back frame, and a back lifting actuator pivotally connected between the back lifting bracket and the back frame for operably driving the back lifting bracket to pivotally move in an upward rotating direction or a downward rotating direction relative to the back frame; and wherein the foot lifting assembly comprises a foot lifting bracket pivotally connected to the foot frame, and a foot lifting actuator pivotally connected between the foot lifting bracket and the foot frame for operably driving the foot lifting bracket to pivotally move in an upward rotating direction or a downward rotating direction relative to the foot frame.

13. The adjustable bed of claim 12, wherein the back lifting actuator comprises a motor member, an outer tube extending from the motor member, and an activation rod having a first end portion received in the outer tube and an opposite, second end portion, wherein the activation rod is engaged with the motor member and configured to be telescopically movable relative to the outer tube according to a direction of motor rotation, wherein the motor member is pivotally connected to the back frame and the second end portion of the activation rod pivotally connected to the back lifting bracket, or wherein the motor member is pivotally connected to the back lifting bracket and the second end portion of the activation rod pivotally connected to the back frame.

14. The adjustable bed of claim 12, wherein the leg lifting actuator comprises a motor member, an outer tube extending from the motor member, and an activation rod having a first end portion received in the outer tube and an opposite, second end portion, wherein the activation rod is engaged with the motor member and configured to be telescopically movable relative to the outer tube according to a direction of motor rotation, wherein the motor member is pivotally connected to the leg frame and the second end portion of the activation rod pivotally connected to the leg lifting bracket, or wherein the motor member is pivotally connected to the leg lifting bracket and the second end portion of the activation rod pivotally connected to the leg frame.

15. The adjustable bed of claim 8, wherein the plurality of platforms further comprises a head platform.

16. The adjustable bed of claim 15, further comprising a head tilt mechanism comprising a head platform tilting actuator pivotally connected to the head platform and the back platform for operably adjusting the head platform in a tilting position or a flat position relative to the back platform.

17. The adjustable bed of claim 16, wherein the head platform tilting actuator comprises a motor member, an outer tube extending from the motor member, an activation rod received in the outer tube, engaged with the motor member and configured to be telescopically movable relative to the outer tube according to a direction of motor rotation, wherein the motor member is pivotally connected to the back platform through a back platform mounting bracket, and the activation rod has a distal end portion pivotally connected to the head platform through a head platform mounting bracket.

18. The adjustable bed of claim 8, further comprising a folding mechanism connecting the back frame and the foot frame such that the back frame and the foot frame are pivotally foldable to one another at the folding mechanism.

* * * * *